United States Patent [19]

Sheng

[11] Patent Number: 5,064,068

[45] Date of Patent: Nov. 12, 1991

[54] LETTER BY LEGAL FOLDING BASKET

[76] Inventor: Tony L. Sheng, 38 Cornell Ave., Livingston, N.J. 07032

[21] Appl. No.: 640,485

[22] Filed: Jan. 11, 1991

[51] Int. Cl.[5] ..... B65D 6/18

[52] U.S. Cl. ..... 206/425; 220/6; 312/184

[58] Field of Search ..... 206/425, 214; 220/6, 220/7; 312/184

[56] References Cited

U.S. PATENT DOCUMENTS

| | | | |
|---|---|---|---|
| 2,755,955 | 7/1956 | Gordon | 220/6 |
| 3,195,506 | 7/1965 | Beard | 220/6 |
| 4,693,387 | 9/1987 | Stonier | 220/6 |
| 4,720,020 | 1/1988 | Su | 220/6 |
| 4,798,304 | 1/1989 | Rader | 220/6 |
| 4,844,277 | 7/1989 | Su | 220/6 |

*Primary Examiner*—Jimmy G. Foster
*Attorney, Agent, or Firm*—Mark H. Jay

[57] ABSTRACT

An all plastic folding basket can be made in a letter by legal size. This is accomplished by using end panels which are recessed at their free ends so as to mate together when the basket is folded, whereby the free ends of the end panels overlap when the basket is folded.

2 Claims, 4 Drawing Sheets

LETTER BY LEGAL FOLDING BASKET

BACKGROUND OF THE INVENTION

The invention relates to folding baskets, and more particularly relates to folding baskets of the all-plastic type.

In conventional all-plastic folding baskets, the depth of the basket corresponds with the depth of a letter- or legal-sized folder, i.e. somewhat over 8.5 inches. Likewise conventionally, the width of the basket corresponds with the width of a letter-sized folder, i.e. somewhat over 11 inches.

In conventional all-plastic folding baskets, the end panels of the basket—which are, as described above, about 8.5 inches high by about 11 inches wide—fold up so that they lie in a common plane when the basket is collapsed. Consequently, the length of the basket must be at least 17 inches (i.e. at least twice 8.5 inches) to accommodate two end panels which are folded up.

A legal-size folder is about 14 inches long. Thus, a conventional folding basket will be longer than a legal-size folder. The extra approximately 3 inches is not only wasteful but is even detrimental, because legal-size folders will slide back and forth within the basket and will not be held in position.

It would be advantageous to provide a folding basket which could have "letter by legal" dimensions, i.e. which would bound an interior cavity that is approximately 8.5 inches high, 14 inches long and 11 inches wide.

One object of the invention is to provide a folding basket which can be manufactured in letter by legal size.

Another object is to provide such a basket in which the length of the basket is not required to be at least twice the depth of the basket.

Another object is, in general, to improve on known baskets of this type.

In accordance with the invention, this is achieved by providing a folding basket which has a rectangular and open-centered top frame. A bottom plate is also provided; its exterior dimensions correspond to those of the frame. Two opposed folding sides connect corresponding longer sides of the frame and plate together.

Two end panels are provided. Each of the end panels has a hinged end and a free end. The hinged end is hinged to the frame. When the basket is unfolded, the end panels are pivoted to close off the ends of the basket between the frame, the plate and the sides. When the basket is folded, the end panels are rotated to be parallel to the plate, and the free ends of the end panels overlap each other. The free ends of the end plates are recessed and mate together so that the end panels lie in a common plane.

BRIEF DESCRIPTION OF THE DRAWINGS

The invention will be better understood with reference to the following illustrative and non-limiting drawings, in which.

DETAILED DESCRIPTION OF A PREFERRED EMBODIMENT

Figure 1:
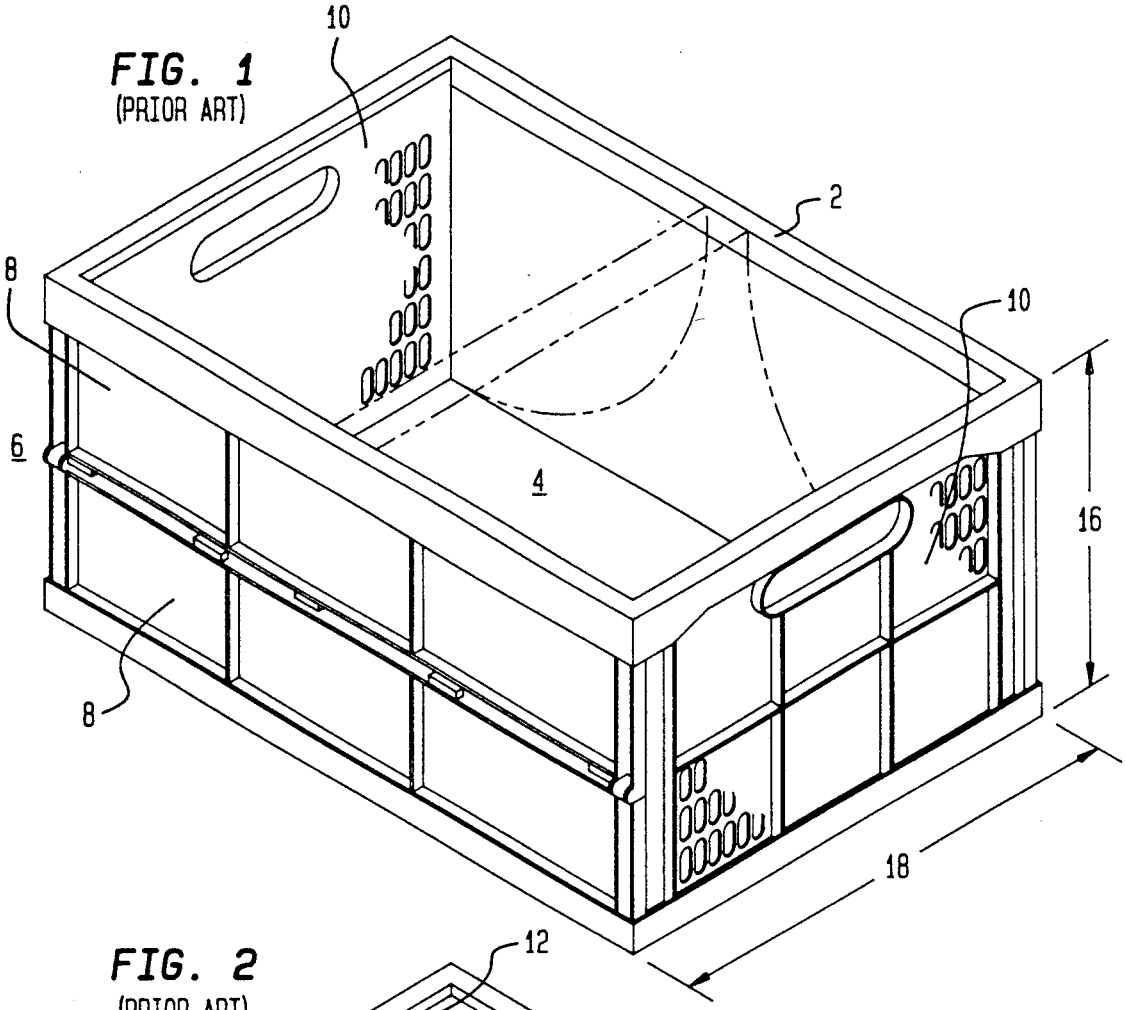
FIG. 1 (PRIOR ART)
FIGS. 1 and 2 show a conventional folding basket in, respectively, an unfolded and folded state.
Figure 2:
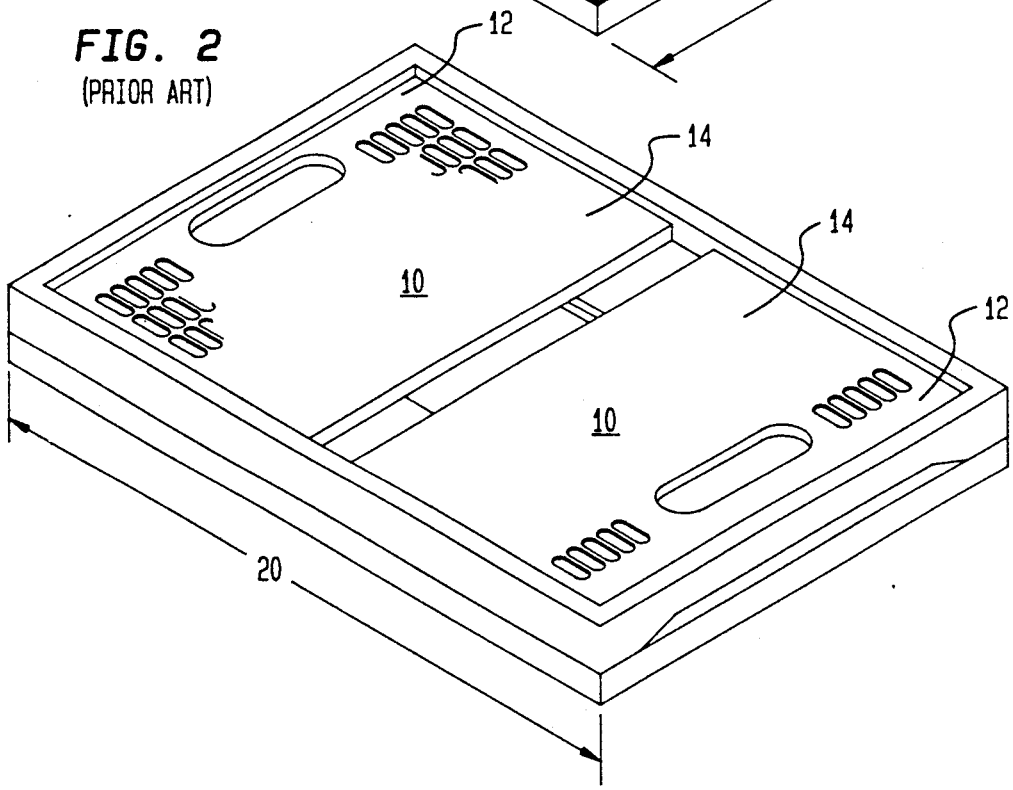
FIG. 2 (PRIOR ART)
Figure 3:
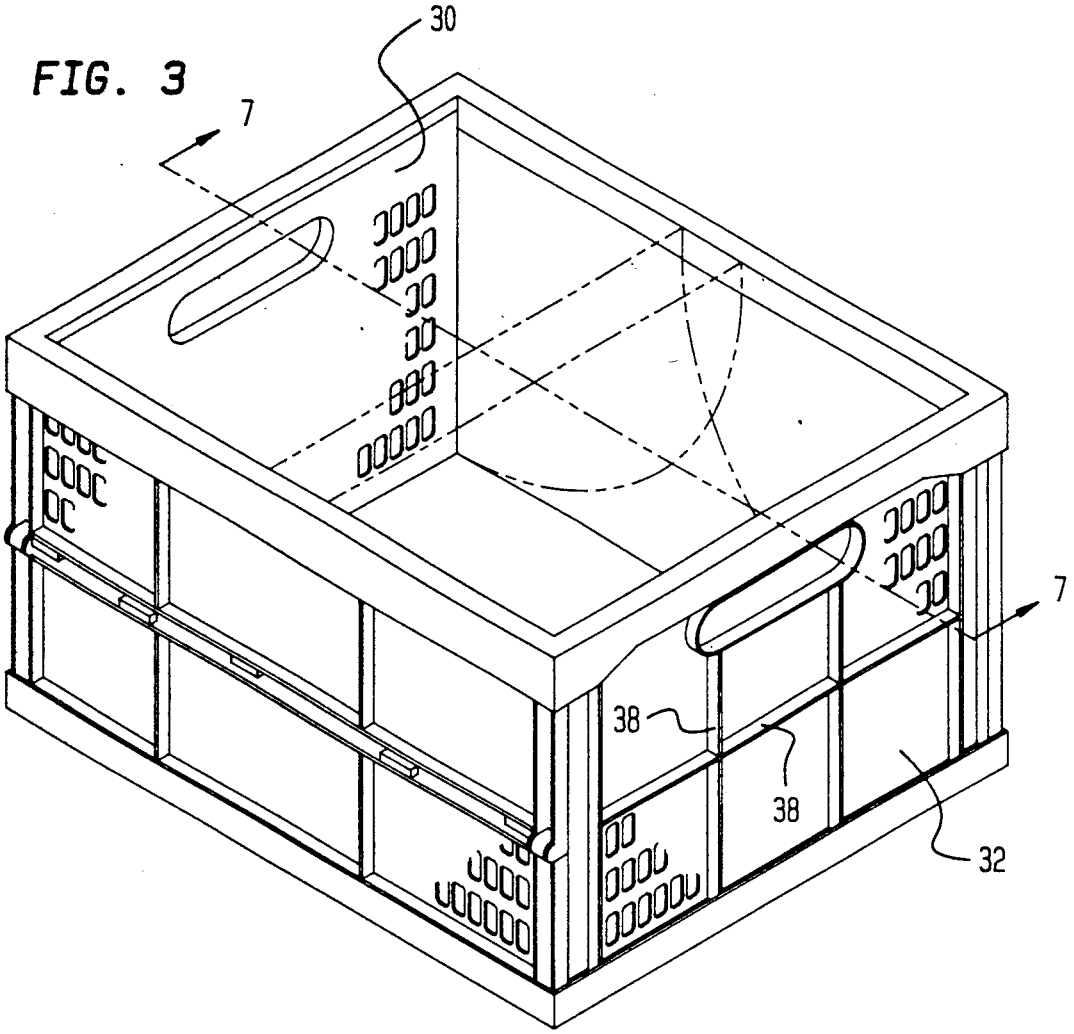
FIGS. 3 and 4 show a preferred embodiment of the invention in, respectively, an unfolded and folded state.
Figure 4:
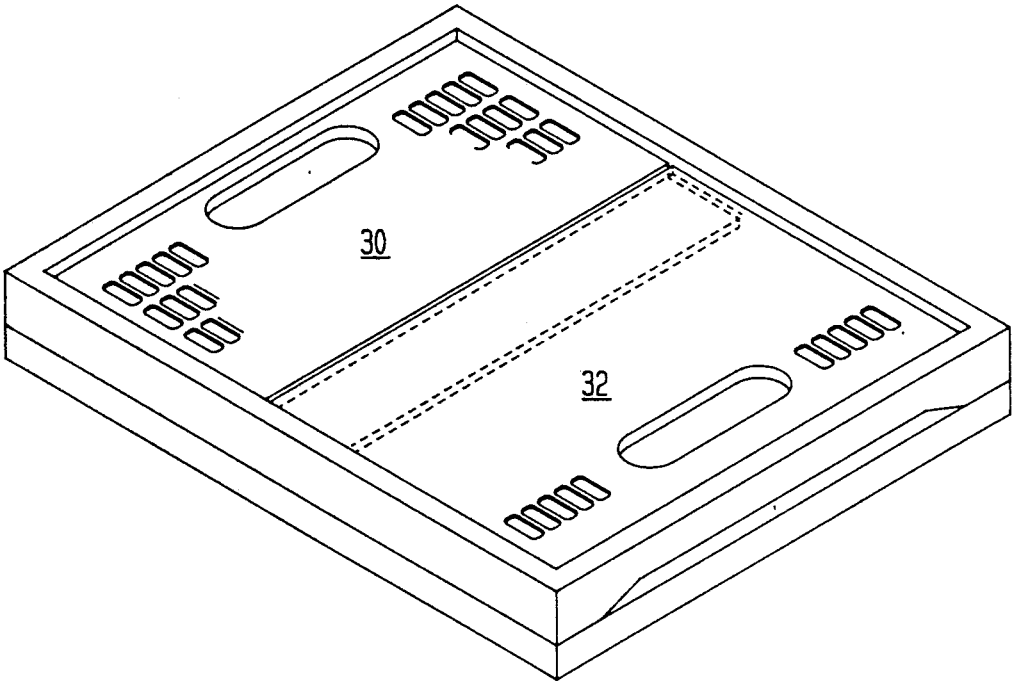
Figure 5:
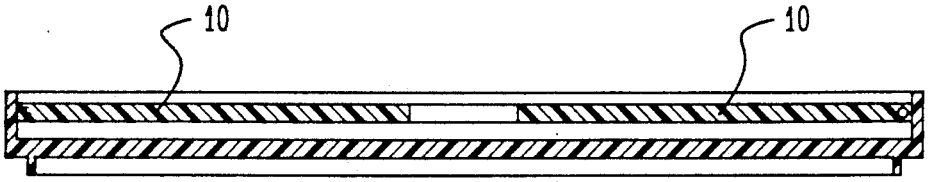
FIG. 5 (PRIOR ART)
FIGS. 5 and 6 are, respectively, cross-sectional views showing the relationship between the end panels of, respectively, a conventional folding basket and a preferred embodiment of the invention, both shown in the folded state.

A conventional folding basket, such as the one shown in FIGS. 1 and 2, has a rectangular open-center top frame 2 and a bottom plate 4. The exterior dimensions of the plate 4 are the same as those of the frame 2.

The longer sides of the frame 2 and the plate 4 are connected together by folding sides generally indicated by reference numeral 6. In the preferred embodiment, each side 6 has two folding leaves 8, but this is not part of the invention.

End panels 10 are used to close off the ends of the basket when the basket is unfolded. Each of the end panels 10 has a hinged end 12 and a free end 14; the hinged end 12 is hinged to one of the shorter sides of the frame 2 and the free end 14 abuts the plate 4 when the box is unfolded and extends into the center of the box when the box is folded.

As will be most easily visualized in connection with FIG. 1, the depth of a letter-size folder (not shown) determines the depth 16 of the end panels 10 and the width of a letter-size folder (not shown) determines the width 18 of the end panels 10. Thus, if the basket is made to hold letter-size folders, the depth 16 of each of the end panels 10 is about 8.5 inches and the width 18 is about 11 inches.

As is evident from FIG. 2, a conventionally constructed folding basket allows the two end panels 10 to lie in a common plane without overlapping. Thus, even if the length 20 of the basket is chosen so that the free ends 14 of the end panels 10 about each other rather than, as is shown in FIG. 2, being spaced apart, the overall length 20 must be at least 17 inches (i.e. two times 8.5 inches). Legal size files are slightly more than 14 inches long. Thus, if the folding basket is made letter-size in one dimension, the other dimension exceeds legal-size.

Figure 8:
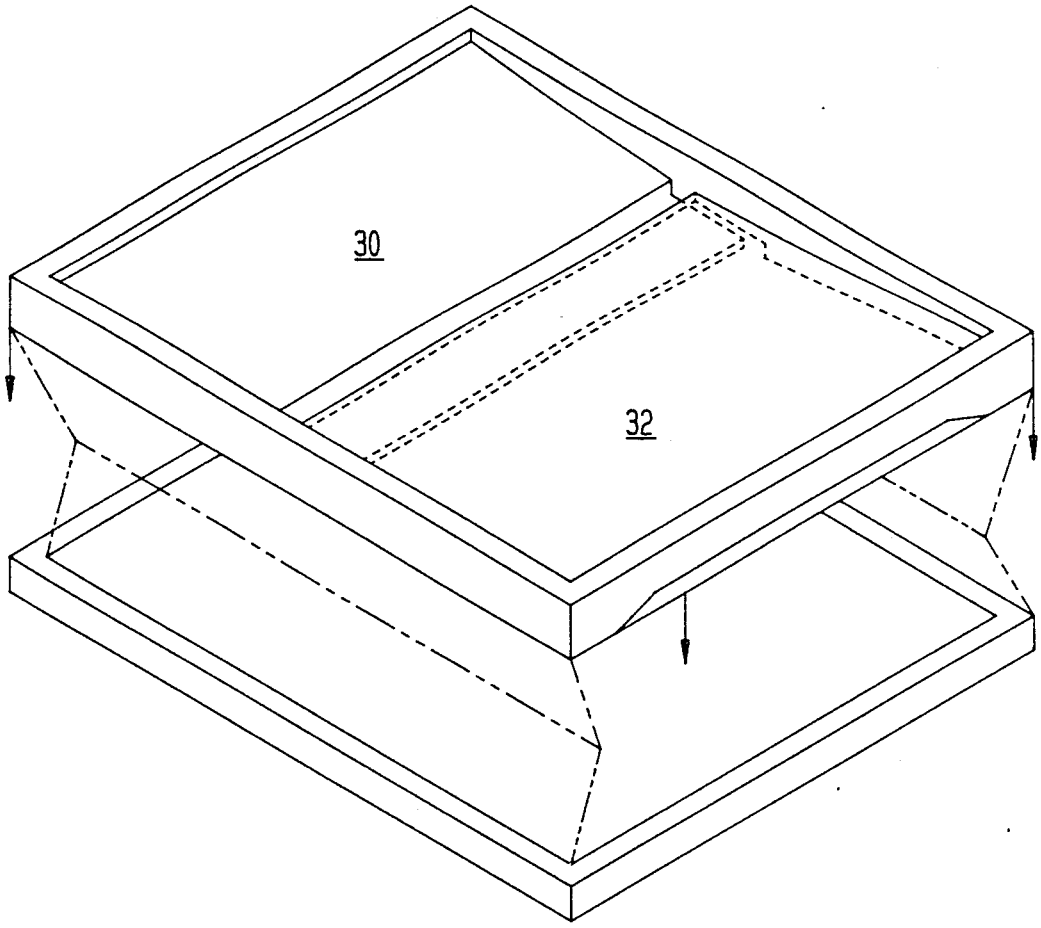
FIG. 8 is a perspective view of a preferred embodiment of the invention illustrating the appearance of the end panels just before the folding process is completed.

In accordance with the invention, the end panels of the preferred embodiment are modified so that the two end panels, when folded up, overlap each other, yet occupy a common plane. This is achieved by, as is best shown in FIG. 8, having recessed regions at the free ends of the end panels and dimensioning the recessed regions so that they mate together when the basket is folded. The other parts of the basket, e.g. the top frame, the bottom plate, are dimensioned accordingly, but are otherwise structurally and operationally identical with the parts used in conventional folding baskets in which letter by legal dimensioning is impossible.

Figure 6:
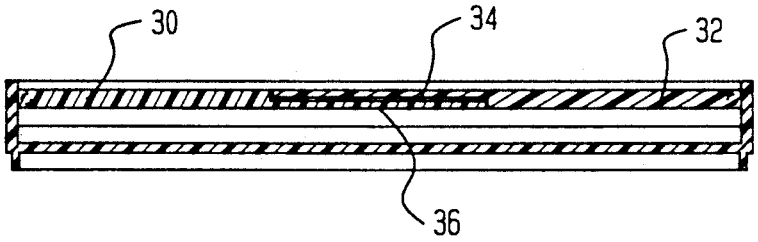
Figure 7:
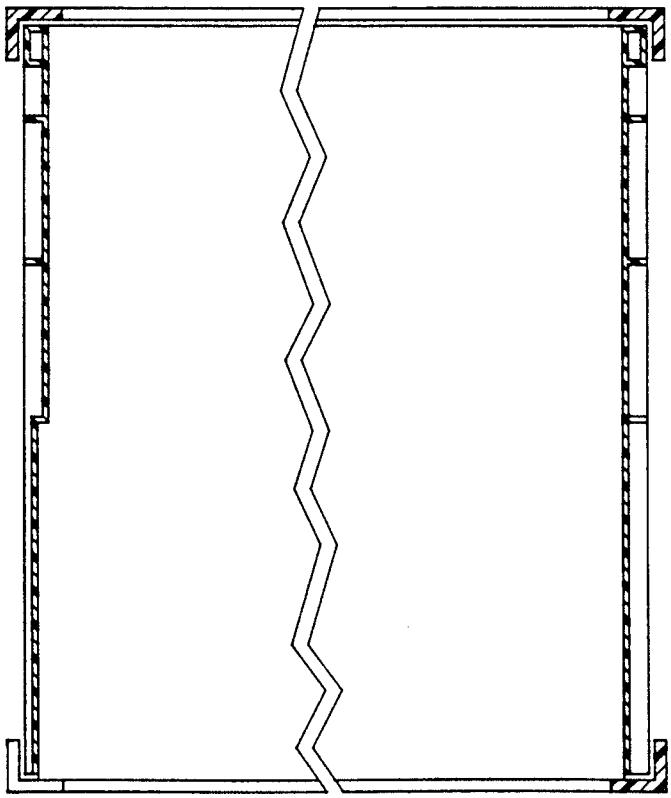
FIG. 7 is a view taken along line 7—7 in FIG. 3.

More particularly, in accordance with the invention, the free end 34, 36 of each of the panels 30, 32 is recessed. The recessed regions are shaped to mate with each other when the basket is folded so that, as is most clearly shown in FIG. 6, the two end panels 30, 32 occupy a common plane when the basket is folded.

In the preferred embodiment, each of the end panels 30, 32 has ribs 38 which extend horizontally and vertically so as to reinforce the end panel 30, 32 and increase its rigidity under load.

It will be understood that the invention does not reside in particular dimensions of a folding basket.

Rather, the invention resides in a structure which is adapted to dimensional modification such that letter by legal dimensionality is possible if desired.

Although a preferred embodiment has been described above, the scope of the invention is limited only by the following claims:

I claim:

1. A rectangular folding basket which can be manufactured in a "letter by legal" size, comprising:

a top frame which is rectangular and open-centered and which has two parallel long sides;

a bottom plate which has exterior dimensions that correspond to those of the frame and likewise has two parallel long sides, each of said long sides of the bottom plate corresponding with one of the long sides of the top frame;

two opposed folding sides, each side being hingedly secured between one of the long sides of the frame and a corresponding one of the long sides of the plate; and two end panels, each end panel having a hinged end and a free end and pivotally secured at its hinged end to the frame in a manner that each panel closes off the basket at one end between the frame, plate and sides when the basket is unfolded and pivots parallel to the plate when the basket is folded, the free ends of the end panels being recessed and mating together in a manner that said free ends overlap when the basket is folded.

2. The folding basket of claim 1, wherein each of the end panels has ribs to reinforce the rigidity of the end panel under load.

* * * * *